United States Patent [19]

Budzich

[11] 4,325,289

[45] Apr. 20, 1982

[54] LOAD RESPONSIVE FLUID CONTROL VALVE

[76] Inventor: Tadeusz Budzich, 80 Murwood Dr., Moreland Hills, Ohio 44022

[21] Appl. No.: 113,288

[22] Filed: Jan. 18, 1980

Related U.S. Application Data

[63] Continuation-in-part of Ser. No. 111,194, Jan. 11, 1980.

[51] Int. Cl.[3] ..... F15B 13/04

[52] U.S. Cl. ..... 91/446; 137/596.1

[58] Field of Search ..... 91/446; 137/596, 596.1, 137/596.13

[56] References Cited

U.S. PATENT DOCUMENTS 3,744,517 7/1973 Budzich ..... 137/596.1 X 4,282,898 8/1981 Harmon et al. ..... 137/596.13

*Primary Examiner*—Gerald A. Michalsky

[57] ABSTRACT

A direction flow control valve for control of negative load equipped with a load responsive negative load control, which automatically regulates valve outlet pressure to maintain a relatively constant pressure differential between negative load pressure and valve outlet pressure and which permits variation in the level of pressure differential in response to an external control signal, while this pressure differential is maintained constant at each controlled level.

34 Claims, 9 Drawing Figures

$$P_w - P_1 = \Delta P_y$$
$$P_2 - P_1 = \Delta P$$
$$P_w - P_2 = \Delta P_x$$
$$\therefore \Delta P_y = \Delta P + \Delta P_x$$

LOAD RESPONSIVE FLUID CONTROL VALVE

This is a continuation in part of application Ser. No. 111,194, filed Jan. 11, 1980 for "Load Responsive Fluid Control Valve".

BACKGROUND OF THE INVENTION

This invention relates generally to load responsive fluid control valves and to fluid power systems incorporating such valves, which systems are supplied with energy from negative system loads.

In more particular aspects this invention relates to load responsive direction and flow control valves capable of proportional control of negative loads, which maintain a constant pressure differential between negative load pressure and valve outlet pressure.

In still more particular aspects this invention relates to load responsive controls of direction control valves, which permit variation in the level of control differential between negative load pressure and valve outlet pressure, while this control differential is automatically maintained constant at each controlled level.

Closed center load responsive direction and flow control valves, capable of proportional control of velocity of negative loads, independent of the load pressure, are very desirable. Such valves, by fluid throttling action, automatically maintain a constant pressure differential between negative load pressure and valve outlet pressure. A variable orifice, introduced between the negative load and valve outlet, varies the flow supplied from negative load, each orifice area corresponding to a different flow level, which is maintained constant irrespective of variation in the magnitude of negative load. Such load responsive direction control valves, for control of negative loads, are disclosed in my U.S. Pat. No. 3,744,517 dated July 10, 1973 and my U.S. Pat. No. 3,882,896 dated May 13, 1975. However, while those valves are effective in proportionally controlling negative loads, they provide a constant pressure differential and therefore a constant throttling action across each valve. Such constant pressure differential is predetermined during construction of the valve control and therefore can not be varied during control of negative load.

SUMMARY OF THE INVENTION

It is therefore a principal object of this invention to provide improved load responsive direction control valve for control of negative load, which permits variation in the level of control differential between negative load pressure and valve outlet pressure, while this control differential is automatically maintained constant at each controlled level.

Another object of this invention is to provide load responsive controls of a direction control valve, through which control of negative load can be either accomplished by variation in area of the orifice, between the fluid motor and valve outlet, while the pressure differential across this orifice is maintained constant at a specific level, or by control of pressure differential, acting across this orifice, while the area of the orifice remains constant.

It is a further object of this invention to provide load responsive controls of a direction control valve, which permit variation in the controlled pressure differential across a metering orifice in response to an external control signal.

It is a further object of this invention to provide load responsive controls of a direction control valve, in which an external control signal, at a minimum force level, can adjust and control the pressure differential, acting across a metering orifice of a load responsive direction control valve controlling a negative load, while the negative load is being controlled by variation in area of the metering orifice.

It is a further object of this invention to provide load responsive controls of direction control valve, which modify control signals, supplied to the valve controls, to control the pressure differential across an orifice of a load responsive direction control valve controlling a negative load.

Briefly the foregoing and other additional objects and advantages of this invention are accomplished by providing novel load responsive control of a direction control valve, to throttle fluid supplied from negative load either in response to one control input, namely variation in the area of metering orifice, to control a constant pressure differential, at a preselected level between negative load pressure and valve outlet pressure, or in response to another control input, namely modification in the pressure of control signal, to vary the level of the control differential between negative load pressure and the valve outlet pressure, while this control differential is automatically maintained constant at each controlled level by valve controls. In this way a load can be controlled in response to either input providing identical control performance, or the variable pressure differential control can be superimposed on the control action controlling a negative load by variation in the area of the metering orifice. Therefore this control system lends itself very well to an application, in which a manual control input from an operator may be modified by an electronic logic circuit, or a microprocessor.

Additional objects of this invention will become apparent when referring to the preferred embodiments of the invention as shown in the accompanying drawings and described in the following detailed description.

DESCRIPTION OF THE PREFERRED EMBODIMENTS

Figure 1:
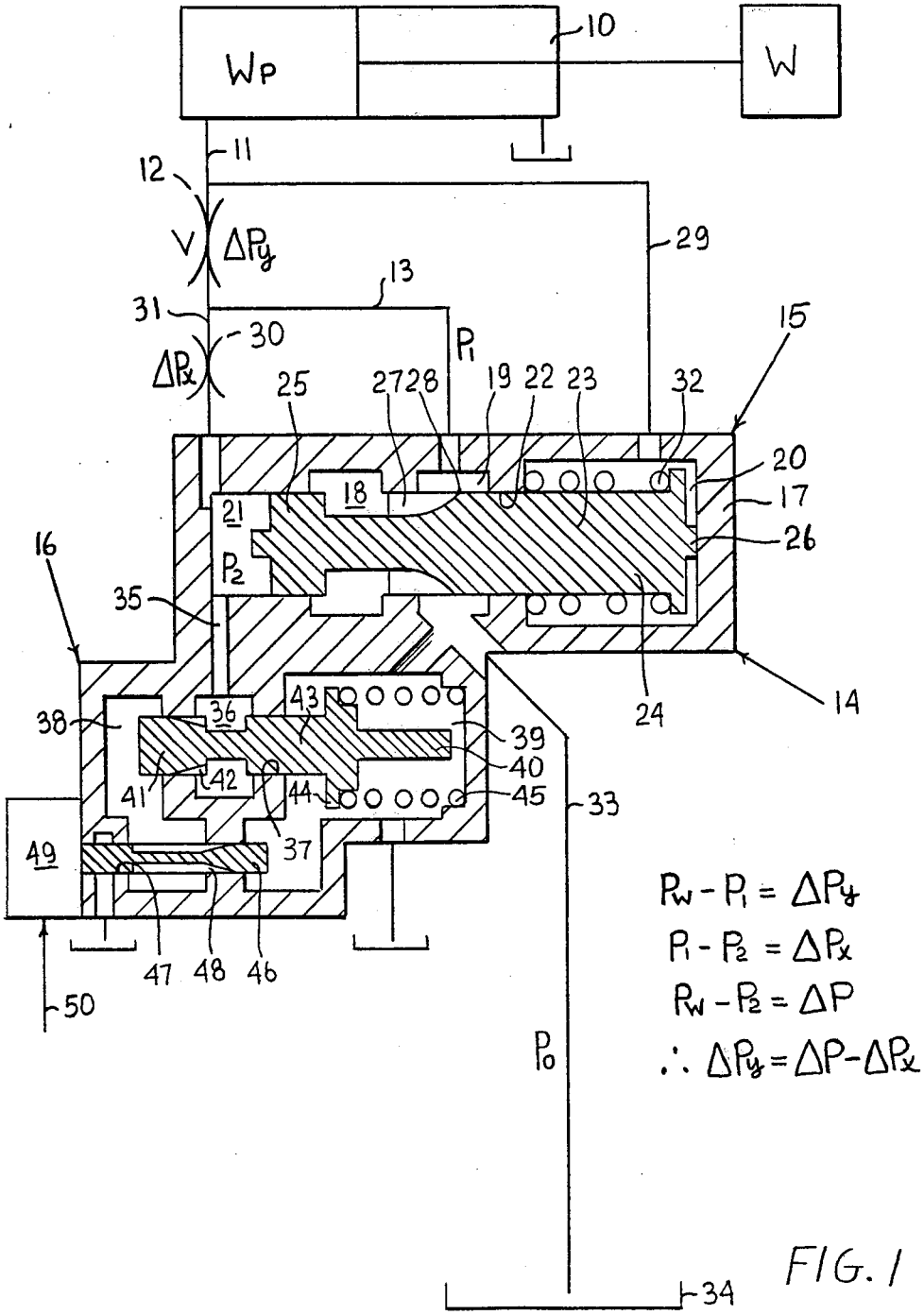
FIG. 1 is a diagrammaric representation of a load responsive negative load pressure throttling control for adjustment in the level of control differential from a certain preselected level to zero level, with fluid motor and reservoir shown schematically.

Referring now to FIG. 1, the hydraulic system shown therein comprises a fluid motor 10 subjected to negative load pressure Wp generated by negative load W. Supply line 11 connects the fluid motor 10 through variable orifice 12 and line 13 to a differential throttling control, generally designated as 14. The differential throttling control 14, composed of throttling section, generally designated as 15 and a signal modifying section, generally designated as 16, comprises a housing 17 having an inlet chamber 18, an outlet chamber 19, a first control chamber 20 and a second control chamber 21, all of those chambers being connected by bore 22, slidably guiding a throttling spool 23. The throttling spool 23, equipped with lands 24 and 25 and stop 26, is provided with throttling slots 27, terminating in cut-off edges 28, between the inlet chamber 18 and the outlet chamber 19. One end of the throttling spool 23 projects into the first control chamber 20, which communicates through line 29 with supply line 11 upstream of variable orifice 12. The other end of the throttling spool 23 projects into the second control chamber 21, which is connected through orifice 30 and line 31 with down stream of variable orifice 12. A control spring 32 in the first control chamber 20 is interposed between the housing 17 and the throttling spool 23. The outlet chamber 19 of the throttling section 15 is connected through exhaust line 33 with a system reservoir 34. The second control chamber 21 is also connected through port 35 with a supply chamber 36, connected by bore 37 with a third control chamber 38 and an exhaust chamber 39. Bore 37 slidably guides a control spool 40, equipped with land 41, provided with throttling slots 42 and positioned between the supply chamber 36 and the third control chamber 38, a land 43 separating the supply chamber 36 and the exhaust chamber 39 and flange 44. A spring 45 is interposed in the exhaust chamber 39 between the flange 44 of the control spool 40 and the housing 17. The exhaust chamber 39 and the third control chamber 38 are selectively interconnected by metering orifice created by a stem 46 guided in bore 47 and provided with metering slots 48. The stem 46 is connected to an actuator 49 responsive to external control signal 50.

Figure 2:
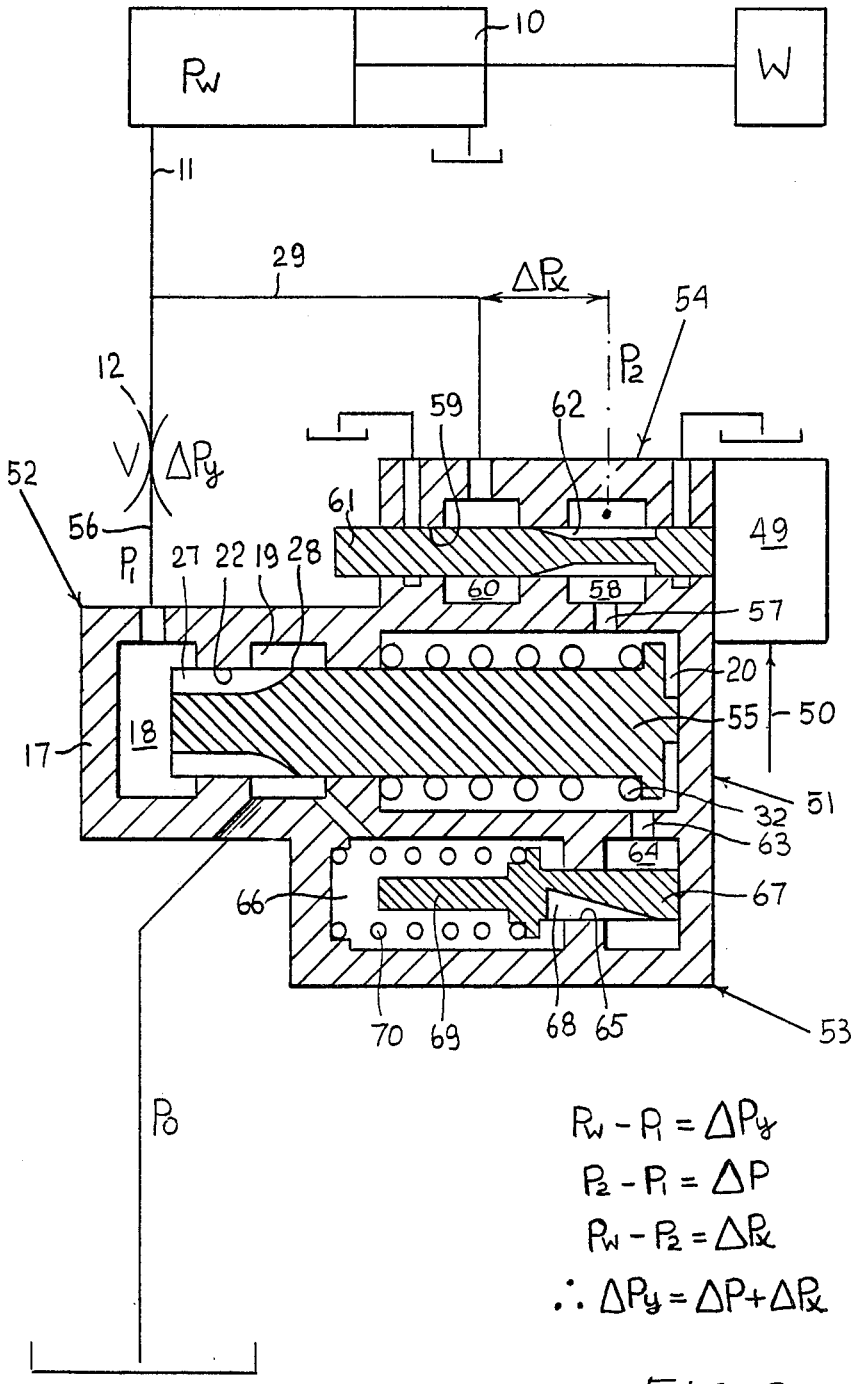
FIG. 2 is a diagrammatic representation of another embodiment of a load responsive negative load pressure throttling control for adjustment in the level of control differential from a certain minimum preselected value up to maximum level, with fluid motor and reservoir shown schematically.

Referring now to FIG. 2, the same components used in FIG. 1 are designated by the same numerals. The basic load responsive circuit of FIG. 2, with some of the circuit components including some of the internal components of differential throttling control, generally designated as 51, are the same as those of FIG. 1. The differential throttling control 51 is composed of a throttling section 52, similar to throttling section 15 of FIG. 1, a flow control valve section 53 and a metering valve section 54. In the arrangement of FIG. 2 the second control chamber 21 of FIG. 1 has been dispensed with and a throttling spool 55 with one end projects directly into the inlet chamber 18. The inlet chamber 18 is connected by line 56 with down stream of variable orifice 12, which in turn is connected by supply line 11 with negative load pressure of the fluid motor 10. The first control chamber 20 is connected by port 57 with a first pressure chamber 58, which in turn is connected through bore 59 with a second pressure chamber 60 communicating through lines 29 and 11 with the fluid motor 10. Bore 59 slidably guides a stem 61, equipped with metering slots 62, which selectively interconnect first and second pressure chambers. The stem 61 is connected to the actuator 49 responsive to external control signal 50. The first control chamber 20 is also connected through port 63 with a third pressure chamber 64, connected by bore 65 with a second exhaust chamber 66. Bore 65 axially guides a metering pin 67, provided with metering slots 68. The metering pin 67 is provided with a stop 69 and biased, towards position as shown, by a spring 70, contained in the second exhaust chamber 66.

Figure 3:
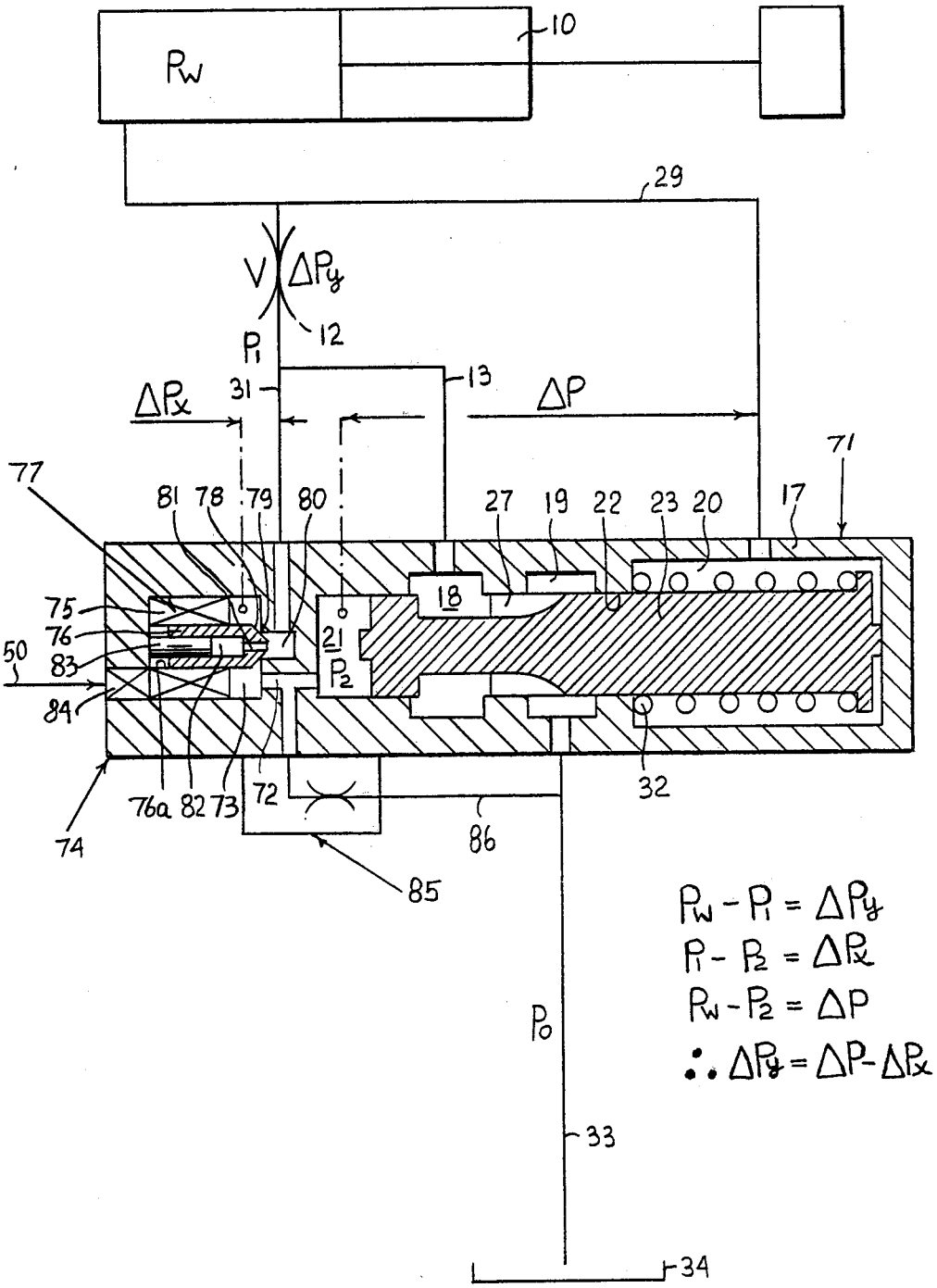
FIG. 3 is a diagrammatic representation of another embodiment of the load responsive negative load pressure throttling control of FIG. 1, with fluid motor and reservoir shown schematically.

Referring now to FIG. 3, the same components used in FIG. 1 are designated by the same numerals. The basic load responsive circuit of FIG. 3 with some of the circuit components, including some of the internal components of differential throttling control, generally designated as 71, are the same as those of FIG. 1. The second control chamber 21 is connected by port 72 to a chamber 73 of differential valve, generally designated as 74. The differential valve 74 comprises a coil 75, retained in the housing, which guides an armature 76 of a solenoid, generally designated as 77. The armature 76 is provided with a conical surface 78, selectively engageable with sealing edge 79 of flow port 80, connected to down stream of variable orifice 12 by line 31. The armature 76 is also provided with venting passage 81 terminating in bore 82, guiding a reaction pin 83. The coil 75 is connected by sealed connector 84 to outside of the housing, external control signal being applied to the sealed connector 84. The second control chamber 21 is connected with schematically shown flow control valve section, generally designated as 85, which may be identical to the flow control valve section 53 of FIG. 2 or can be a conventional fixed area orifice. Flow control valve section 53 is connected by line 86 with exhaust line 33 leading to the reservoir 34.

Figure 4:
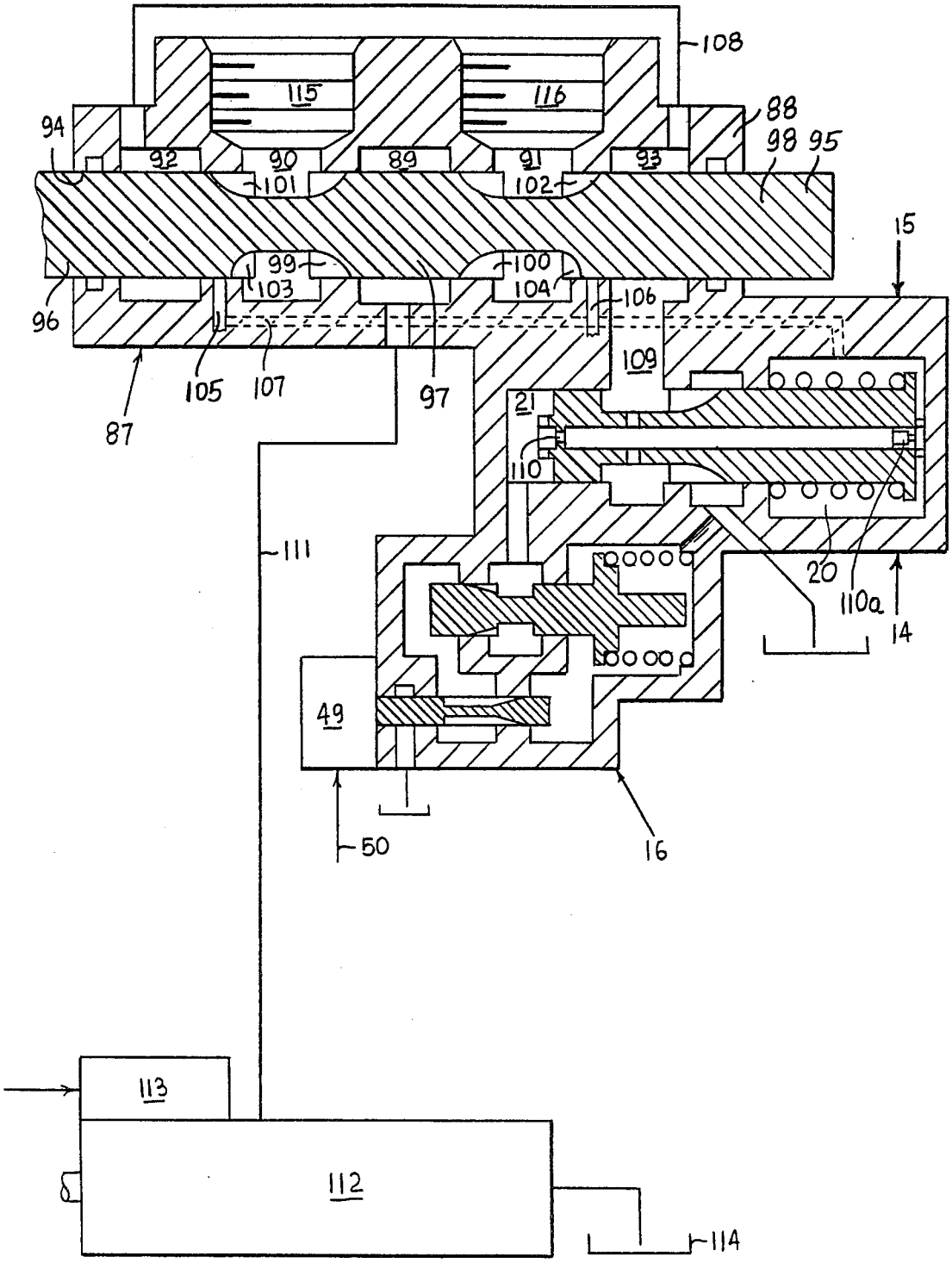
FIG. 4 is a sectional view through a four way load responsive direction control valve for control of negative load using the control of FIG. 1, with system pump and reservoir shown schematically.

Referring now to FIG. 4 the same components used in FIG. 1 are designated by the same numerals. The differential throttling control 14 of FIG. 1 was integrated in FIG. 4 into a four way valve assembly, generally designated as 87, which is basically equivalent to variable metering orifice 12 of FIG. 1. The four way valve assembly, generally designated as 87, comprises a housing 88 having an inlet chamber 89, load chambers 90 and 91 and outlet chambers 92 and 93, interconnected by bore 94, guiding a valve spool 95. The valve spool 95 is provided with lands 96, 97 and 98, throttling slots 99, 100, 101 and 102 and signal slots 103 and 104. The housing 88 is also provided with load sensing ports 105 and 106 communicating though passage 107 with the first control chamber 20 of differential throttling control 14. Outlet chambers 92 and 93 interconnected by line 108 communicate through core 109 and orifice 110 with the second control chamber 21 of differential throttling control 14. Orifice 110 is also connected by unnumbered passages with a leakage orifice **110*a* communicating with the first control chamber 20. The inlet chamber 89 is connected by line 111 to a system pump 112 controlled by pump control 113 and supplied with suction fluid from a reservoir 114. Load chambers 90 and 91 are connected by ports 115 and 116** to a fluid motor not shown.

Figure 5:
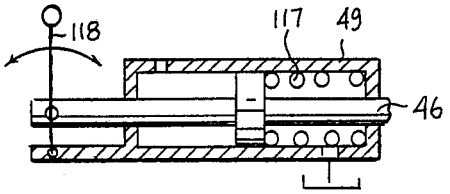
FIG. 5 is a diagrammatic representation of manual control input into the load responsive controls of FIGS. 1 to 4.

Referring now to FIG. 5, the stem 46 of the actuator 49 of FIGS. 1 to 4 is biased by a spring 117 towards position of zero orifice and is directly operated by a lever 118, which provides the external signal 50.

Figure 6:
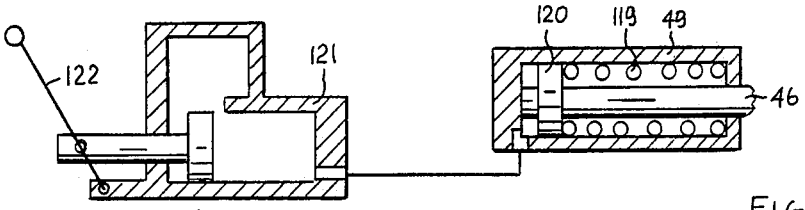
FIG. 6 is a diagrammatic representation of hydraulic control input into load responsive controls of FIGS. 1 to 4.

Referring now to FIG. 6, the stem 46 of the actuator 49 of FIGS. 1 to 4 is biased by a spring 119 towards position of zero orifice and is directly operated by a piston 120. Fluid pressure is supplied to the piston 120 from a pressure generator 121, operated by a lever 122.

Figure 7:
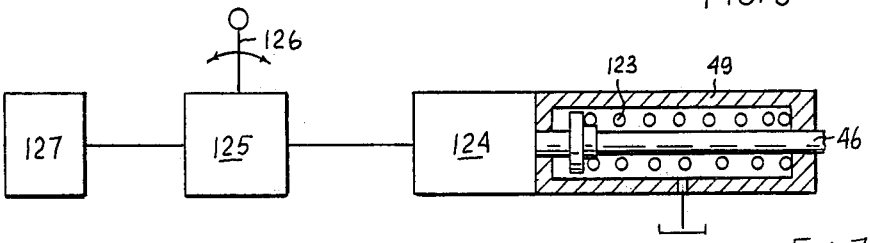
FIG. 7 is a diagrammatic representation of electro-hydraulic control input into load responsive controls of FIGS. 1 to 4.

Referring now to FIG. 7, the stem 46 of the actuator 49 of FIGS. 1 to 4, is biased by a spring 123 towards position of zero orifice and is directly operated by a solenoid 124, connected by line to an input current control 125, operated by a lever 126 and supplied from an electrical supply source 127.

Figure 8:
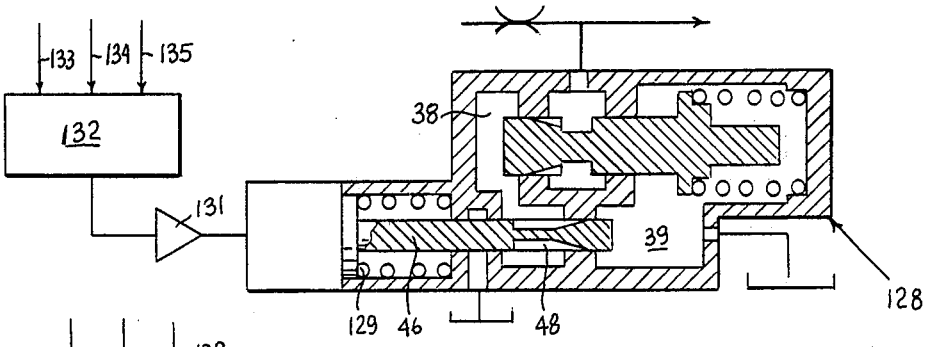
FIG. 8 is a diagrammatic representation of an electro-mechanical control input into load responsive controls of FIGS. 1 to 4.

Referring now to FIG. 8, the stem 46 of the differential control, generally designated as 128, is biased by a spring 129 towards a position, where it isolates the third control chamber 38 from the exhaust chamber 39 and is controlled by a solenoid 130. The electrical control signal, amplfied by amplifier 131, is transmitted from a logic circuit or a micro-processor 132, subjected to inputs 133, 134 and 135.

Figure 9:
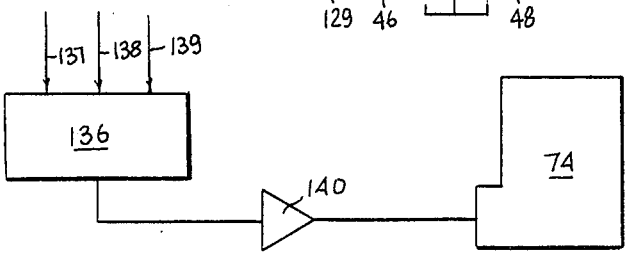
FIG. 9 is a diagrammatic representation of an electro-mechanical control input into load responsive system of FIG. 3.

Referring now to FIG. 9, a logic circuit or a microprocessor 136, supplied with control signals 137, 138 and 139, transmits an external control signal to the differential valve 74 of FIG. 3 through an amplifier 140.

Referring now to FIG. 1, the differential throttling control 14 is interposed between the fluid motor 10 and the reservoir 34 and controls the fluid flow and pressure therebetween. The differential throttling control 14 is composed of the throttling section 15 and the signal modifying section 16. The throttling section 15 with its throttling spool 23 throttles with throttling slots 27 fluid flow from the inlet chamber 18, connected by line 13, variable orifice 12 and supply line 11 to the fluid motor 10, to the outlet chamber 19, connected by line 33 with the system reservoir 34, to automatically maintain a constant pressure differential across variable orifice 12. This control action is accomplished in the following way. Fluid from the fluid motor 10 at Pw pressure, which is the pressure acting upstream of variable orifice 12 is transmitted through line 29 to the first control chamber 20 where, reacting on the cross-sectional area of the throttling spool 23, generates a force tending to move the throttling spool 23 from right to left, in the direction of closing of the flow area through the throttling slots 27 and therefore in direction of increasing the throttling action of the throttling spool 23. Fluid at the pressure $P_1$ which is the pressure acting down stream of variable orifice 12, is transmitted through line 31 and orifice 30 to the second control chamber 21 where, reacting on the cross-sectional area of the throttling spool 23, it generates a force tending to move the throttling spool 23 from left to right, in the direction of increasing the flow area through the throttling slots 27 and therefore in direction of decreasing the throttling action of the throttling spool 23. This force due to pressure in the second control chamber 21 is supplemented by the biasing force of the control spring 32. Assume that the stem 46 is in the position, as shown in FIG. 1, isolating the third control chamber 38 from the exhaust chamber 39 and therefore making the signal modifying section 16 inactive. The throttling spool 23, subjected to Pw and $P_2$ pressures and biasing force of control spring 32, will reach a modulating position, in which by throttling action of throttling slots 27 will throttle $P_1$ pressure to maintain a constant pressure differential $\Delta P$ across variable orifice 12 which is equal to the quotient of the biasing force of control spring 32 and the cross-sectional area of the throttling spool 23. If $P_2$ pressure is equal to $P_1$ pressure, which is the case when the stem 46 is in the position, as shown in FIG. 1, the throttling section 15, by throttling fluid flow from the inlet chamber 18 to the outlet chamber 19, will automatically maintain a constant pressure differential $\Delta P$ between the first control chamber 20 and the second control chamber 21 and with $\Delta Py$ becoming $\Delta P$, will also maintain a constant pressure differential across variable orifice 12. With constant pressure differential, acting across an orifice, the flow through an orifice will be proportional to the area of the orifice and independent of pressure in the fluid motor. Therefore by varying the area of variable orifice 12, the fluid flow from the fluid motor 10 and velocity of the load W can be controlled, each specific area of variable orifice 12 corresponding to a specific velocity of load W, which will remain constant, irrespective of the variation in the magnitude of the load W.

In the arrangement of FIG. 1 the relationship between $P_1$ pressure down stream of variable orifice 12 and signal pressure $P_2$ is controlled by the signal modifying section, generally designated as 16, and orifice 30. Assume that the stem 46, positioned by the actuator 49 in response to external control signal 50, as shown in FIG. 1, blocks completely metering orifice through metering slots 48, isolating the third control chamber 38 from the exhaust chamber 39. The control spool 40 with its land 41, protruding into the third control chamber 38, will generate pressure in the third control chamber 38, equivalent to the preload of the spring 45. Displacement of the stem 46 to the right will move metering slots 48 out of bore 47, creating an orifice area, through which fluid flow will take place from the third control chamber 38 to the exhaust chamber 39. The control spool 40, biased by the spring 45, will move from right to left, connecting by throttling slots 42 the supply chamber 36 with the third control chamber 38. Rising pressure in the third control chamber 38, reacting on cross-sectional area of control spool 40, will move it back into a modulating position, in which sufficient flow of pressure fluid will be throttled from the supply chamber 36 to the third control chamber 38, to maintain the third control chamber 38 at a constant pressure, equivalent to preload in the spring 45. When displacing metering slots 48, in respect to bore 47, area of metering orifice between the third control chamber 38 and the exhaust chamber 39 will be varied. Since constant pressure differential is automatically maintained between the exhaust chamber 39 and the third control chamber 38 and therefore across the metering slots 48, by the control spool 40, each specific area of metering slots 48 will correspond to a specific constant flow level from the third control chamber 38 to the exhaust chamber 39 and from the supply chamber 36 to the third control chamber 38, irrespective of the magnitude of the pressure in the supply chamber 36. Therefore, each specific position of stem 46, within the zone of metering slots 48, will correspond to a specific flow level and therefore a specific pressure drop $\Delta Px$ through the fixed orifice 30, irrespective of the magnitude of the load pressure Pw. When referring to FIG. 1 it can be seen that $Pw-P_1=\Delta Py$, $Pw-P_2=\Delta P$, maintained constant by the throttling section 16 and $P_1-P_2=\Delta Px$. From the above equations, when substituting and eliminating $P_1$ and $P_2$ a basic relationship of $\Delta Py=\Delta P-\Delta Px$ is obtained. Since ΔPx can be varied and maintained constant at any level by the signal modifying section 16, so can ΔPy, acting across variable orifice 12, be varied and maintained constant at any level. Therefore with any specific constant area of variable orifice 12, in response to control signal 50, pressure differential ΔPy can be varied from maximum to zero, each specific level of ΔPy being automatically controlled constant, irrespective of variation in the load pressure Pw. Therefore, for each specific area of variable orifice 12 the pressure differential, acting across orifice 12 and the flow through orifice 12 can be controlled from maximum to minimum by the signal modifying section 16, each flow level automatically being controlled constant by the differential throttling control 14, irrespective of the variation in the load pressure Pw. From inspection of the basic equation $\Delta Py = \Delta P - \Delta Px$ it becomes apparent that with $\Delta Px = 0$, $\Delta Py = \Delta P$ and that the system will revert to the mode of operation of conventional load responsive system, with maximum constant ΔP of the differential throttling control 14. When $\Delta Px = \Delta P$, ΔPy becomes zero, inlet pressure to the throttling section 15 $P_1$ will be equal to load pressure Pw and the flow through variable orifice 12 will become zero.

In the load responsive system of FIG. 1 for each specific value of ΔPy, maintained constant by the signal modifying section 16 through the throttling section 15 of the differential control 14, the area of variable orifice 12 can be varied, each area corresponding to a specific constant flow from the fluid motor 10, irrespective of the variation in the magnitude in the load pressure Pw. Conversely, for each specific area of the variable orifice 12 pressure differential ΔPy, acting across orifice 12, can be varied by the signal modifying section 16, through the throttling section 15 of the differential throttling control 14, each specific pressure differential ΔPy corresponding to a specific constant flow from the fluid motor 10 irrespective of the variation in the magnitude of the load pressure Pw. Therefore fluid flow from fluid motor 10 can be controlled either by variation in area of variable orifice 12, or by variation in pressure differential ΔPy, each of those control methods displaying identical control characteristics and controlling flow, which is independent of the magnitude of the load pressure. Action of one control can be superimposed on the action of the other, providing a unique system, in which, for example, a command signal from the operator, through the use of variable orifice 12 can be corrected by signal 50 from a computing device, acting through the signal modifying section 16.

Referring now to FIG. 2, the load responsive system is similar to the load responsive system of FIG. 1 with the exception of the flow control valve section 53 and the metering valve section 54, which, when combined together are equivalent to the signal modifying section 16 of FIG. 1 and perform in a very similar way. However, the combined signal modifying section of FIG. 2 modifies the control signal from the fluid motor 10 and therefore from upstream of the variable orifice 12, instead of modifying the control signal of $P_2$ pressure, as shown in the system of FIG. 1. The throttling section 52 of FIG. 2 is similar to the throttling section 15 of FIG. 1, although a throttling spool 55 protrudes into the inlet chamber 18 instead of into the second control chamber 21 of FIG. 1. It is apparent that the differential throttling control 51 of FIG. 2 performs in a similar way as the differential throttling control 14 of FIG. 1. The flow control valve section 53 of the differential throttling control 51 in the housing 17, is provided with bore 65, guiding the metering pin 67, which is subjected to pressure in the third pressure chamber 64, which is connected by port 63 with the first control chamber 20, to the reservoir pressure in the second exhaust chamber 66 and to the biasing force of the spring 70. Subjected to pressure in the third pressure chamber 64 the metering pin 67 will move from right to left, each specific pressure level corresponding to a specific position of metering pin 67, in respect to the bore 65 and also corresponding to the specific biasing force of spring 70. Each specific position of metering pin 67, in respect to bore 65, will correspond to a specific flow area of metering slot 68, interconnecting the third pressure chamber 64 with the second exhaust chamber 66. The shape of metering slot 68 and the characteristics of the biasing spring 70 are so selected, that variation in effective orifice area of metering slot 68, in respect to pressure in the third pressure chamber 64, will provide a relatively constant flow from the third pressure chamber 64 to the second exhaust chamber 66. To obtain special control characteristics of the load responsive control the shape of the metering slot 68 may be so selected, that any desired relationship between the flow from the third pressure chamber 64 and its pressure level can be obtained. Assume that the flow control valve section 53 provides a constant flow from the third pressure chamber 64 and therefore from the first control chamber 20, irrespective of its pressure level. Then, in a well known manner, the flow control valve section 53 could be substituted by a conventional flow control valve, well known in the art. Constant flow to the third pressure chamber 64 is supplied from fluid motor 10 through the metering valve section 54, first control chamber 20 and port 63. The metering valve section 54, upstream of the flow control valve section 53 is provided with a bore 59, guiding the stem 61, provided with metering slots 62. Displacement of metering slots 62 past bore 59 creates an orifice, the effective area of which can be varied by positioning of stem 61 by the actuator 49, in response to external control signal 50. With stem 61 engaging bore 59 the flow area of the metering valve section 54 becomes zero. Therefore, in response to external control signal 50, the effective flow area through the metering valve section 54 can be varied from zero to a selected maximum value. Since the flow through the metering valve section 54 is maintained constant by the flow control valve 53, each specific area of flow through the metering valve section 54, in a well known manner, will correspond to a specific constant pressure drop ΔPx, irrespective of the variation in the load pressure Pw. Therefore the load pressure signal can be modified in the first control chamber 20 of the throttling section 52, each value of pressure drop ΔPx, maintained constant by the flow control valve section 53. Therefore, as can be seen in FIG. 2, $Pw - P_1 = \Delta Py$, $Pw - P_2 = \Delta Px$ and $P_2 - P_1 = \Delta P$, which, in a manner as previously described, is the basic system differential and is maintained constant by the throttling section 52 of the differential throttling control 53. From the above equations, when substituting and eliminating $P_1$ and $P_2$, the basic relationship of $\Delta Py = P\ \Delta P + \Delta Px$ can be obtained. Since ΔPx can be varied and maintained constant at any level, so can ΔPy, acting across variable orifice 12 be varied and maintained constant at any level. From inspection of the basic equation $\Delta Py = \Delta P + \Delta Px$ it becomes apparent that with $\Delta Px = 0$, $\Delta Py = \Delta P$ and that the system will revert to the mode of operation of conventional load responsive system, with minimum constant ΔP equal to pressure differential of the throttling section 53. Any value of ΔPx, other than zero, will increase the pressure differential ΔPy, acting across variable orifice 12 above the level of constant pressure differential ΔP of the throttling section 52. Therefore, the load responsive control arrangment of FIG. 1 will control ΔPy in a range between ΔP and zero, while the load responsive arrangement of FIG. 2 will control ΔPy in a range above the level of constant pressure differential ΔP of the throttling section 13*a*. The signal modifying section 16 of FIG. 1, by modifying the control signal of the negative load pressure Pw can be made to perform in an identical way as the control arrangement of FIG. 2.

In a manner as previously described the shape of metering slot 68 and the biasing force characteristics of spring 70 can be so selected, that any desired relationship between pressure in the third pressure chamber 64 and the fluid flow through the metering valve section 54 can be obtained. Assume that in response to a specific external control signal 50 a specific flow area was created through the metering valve section 54. Then controlled increase in flow through the metering valve section 54, with increase in load pressure, will proportionally increase the pressure differential ΔPx and therefore proportionally increase the pressure differential ΔPy, effectively increasing the gain of the load responsive control with increase in the load pressure. Conversely, a controlled decrease of flow through the specific orifice area of the metering valve section 54, with increase in the load pressure will proportionally decrease the pressure differential ΔPx and therefore proportionally decrease the pressure differential ΔPy, effectively decreasing the gain of the load responsive control, with increase in the load pressure. As is well known in the art, the stability margin of most fluid flow and pressure controllers decreases with increase in system pressure. Therefore the capability of adjusting the system gain, in respect to system pressure, is of primary importance. With the flow control valve section 53 the rate of change of pressure differential ΔPy, in respect to load pressure, does not have to be constant and can be varied in any desired way.

Referring now to FIG. 3, the load responsive system is similar to that of FIG. 1. The throttling control of the differential throttling control 71 of FIG. 3, is identical to differential throttling section 15 of FIG. 1. However, the differential valve 74 is different from the signal modifying section 16 of FIG. 1, although it performs the same function and provides identical performance. The differential valve, generally designated as 74, contains the solenoid, generally designated as 77, which consists of coil 75, secured in the housing 17 and the armature 76, slidably guided in the coil 75. The armature 76 is provided with conical surface 78, which, in cooperation with sealing edge 79, regulates the pressure differential ΔPx between flow port 80 and the chamber 73. The sealed connector 84, in the housing 17, well known in the art, connects the coil 75 with external terminals, to which the external signal 50 can be applied. A solenoid is an electro-mechanical device, using the principle of electro-magnetics, to produce output forces from electrical input signals. The force developed on the solenoid armature 76 is a function of the input current. As the current is applied to the coil 75, each specific current level will correspond to a specific force level, transmitted to the armature. Therefore, the contact force between the conical surface 78 of the armature 76 and sealing edge 79 of housing 17 will vary and be controlled by the input current. This arrangement will then be equivalent to a type of differential pressure throttling valve varying automatically the pressure differential ΔPx between flow port 80 and the second control chamber 21, in proportion to the force developed in the armature 76, in respect to the area enclosed by the sealing edge 79 and therefore proportional to the external signal 50, of the input current supplied to the solenoid 77. The pressure forces acting on the armature 76, within the housing 17, are completely balanced with the exception of the pressure force due to the pressure differential ΔPx acting on the enclosed area of sealing edge 79. This is partially balanced by the reaction force, developed on the cross-sectional area of the reaction pin 83, guided in a bore 82, which is connected through venting passage 81 with flow port 80. The cross-sectional area of the reaction pin 83 must always be smaller than the area enclosed by sealing edge 79, so that a positive force, due to the pressure differential ΔPx, opposes the force developed by the solenoid 77. The reaction pin 83 permits use of a larger flow port 80, while also permitting a very significant reduction in the solenoid 77, also permitting the solenoid 77 to work in the higher range of ΔPx. The second control chamber 21 may be connected by the control valve section 85, described in detail when referring to flow control valve section 53 of FIG. 2, with the system reservoir. The control valve section 85 may also take the form of a simple orifice.

Referring now to FIG. 4, the load responsive system is identical to that as shown in FIG. 1 with identical differential throttling controls being used, but the variable orifice 12 of FIG. 1 was substituted in FIG. 4 by a load responsive four way type direction control valve, generally designated as 87. The performance of the control embodiment of FIGS. 1 and 4 is identical, the only difference being the construction of the variable orifice. The differential throttling control and specifically the first control chamber 20 are connected through passage 107 with the load sensing ports 105 and 106 of the four way valve 87. The second control chamber 21 is connected through orifice 110 and core 109 with outlet chambers 93 and 92. Orifice 110 of FIG. 4 performs the same function as orifice 30 of FIG. 1. With the valve spool 95 in its neutral position, as shown in FIG. 4, load pressure sensing ports 105 and 106 are blocked by the land 97 and therefore effectively isolated from load pressure, existing in load chamber 90 or 91. Under those conditions, through leakage orifice 110*a*, the first control chamber 20 is maintained at atmospheric pressure. Displacement of the valve spool 95 from its neutral position in either direction, first connects with signal slot 103 or 104 load chamber 90 or 91 with load pressure sensing port 105 or 106, while load chambers 90 and 91 are still isolated by the valve spool 95 from the inlet chamber 89 and outlet chambers 92 and 93. Then the load pressure signal is transmitted through load pressure sensing port 105 or 106 and passage 107 to the first control chamber 20, permitting the differential throttling control 14 to react, before metering orifice is open to the load chamber 90 or 91. Further displacement of valve spool 95, in either direction, will create, in a well known manner, through metering slot 101 or 102 a metering orifice between one of the load chambers and the outlet chamber 92 or 93, while connecting the other load chamber, through metering slot 99 or 100 with the inlet chamber 89. The metering orifice can be varied by displacement of valve spool 95, each position corresponding to a specific flow level out of one of the load chambers, irrespective of the magnitude of the load controlled by four way valve assembly 87. Upon this control, in a manner as previously described when referring to FIG. 1, can be superimposed the control action of the signal modifying section 16. With valve spool 95 displaced to any specific position, corresponding to any specific area of metering orifice, the flow out of load chambers can be proportionally controlled by the differential throttling control 14 with its signal modifying section 16, each value of pressure differential ΔPy being automatically maintained at a constant level by the throttling section 15 and corresponding to a specific flow level out of one of the load chambers, irrespective of the magnitude of the load controlled by the four way valve assembly 87.

Referring now to FIG. 5, the stem 46 of the actuator 49 of FIGS. 1 to 4 is biased by spring 117 towards position of zero orifice and is directly operated by a lever 118, which provides the external signal in the form of manual input.

Referring now to FIG. 6, the stem 46 of actuator 49 of FIGS. 1 to 4 is biased by spring 119 towards position of zero orifice and is directly operated by a piston 120. Fluid pressure is supplied, in a well known manner, to the piston 120 from a pressure generator 121, operated by a lever 122. Therefore the arrangement of FIG. 6 provides the external signal 50 in the formof a fluid pressure signal.

Referring now to FIG. 7, the stem 46 of the actuator 49 of FIGS. 1 to 4 is biased by a spring 123 towards position of zero orifice and is directly operated, in a well known manner, by a solenoid 124, connected by a line to an input current control 125, operated by a lever 126 and supplied from an electrical power source 127. Therefore the arrangement of FIG. 7 supplies the external signal 50 in the form of an electric current, proportional to displacement of lever 126.

Referring now to FIG. 8, the stem 46 of the differential control 128 is biased by a spring 129 towards a position, where it isolates the third control chamber 38 from the exhaust chamber 39. The stem 46 is completely pressure balanced, can be made to operate through a very small stroke and controls such low flows, at such low pressures, that the influence of the flow forces is negligible. In any event, if the area of metering slots 48 is so selected, that it provides a linear function in respect to displacement of the stem 46 and a constant pressure is maintained in front of the orifice, the flow force will also be linear and will add to the spring force, changing slightly the combined rate of the spring. The stem 46 is directly coupled to a schematically shown solenoid. A solenoid is an electro-mechanical device using the principle of electro-magnetics, to produce output forces from electrical input signals. The position of solenoid armature, when biased by a spring, is a function of the input current. As the current is applied to the coil, the resulting magnetic forces generated move the armature from its deenergized position to it energized position. When biased by a spring, for each specific current level there is a corresponding particular position, which the solenoid will attain. As the current is varied from zero to maximum rating, the armature will move one way from a fully retracted to a fully extended position in a predictable fashion, depending on the specific level of current at any one instant. Since the forces, developed by the schematically shown solenoid are very small, so is the input current, which is controlled by a logic circuit or a microprocessor 132. The micro-processor 132 will then, in response to different types of transducers either directly control the system load, in respect to speed, force and position, or can superimpose its action upon the control function of an operator, to perform required work in the minimum time, with a minimum amount of energy, within the maximum capability of the structure of the machine and within the envelope of its horsepower.

Referring now to FIG. 9, the control signal from the logic circuit, or the micro-processor 136, in a similar way as described in FIG. 8, is directly transmitted through the amplifier 140 to the differential pressure control 74 of FIG. 3, where, through a solenoid and throttling valve combination, in a manner as previously described, when referring to FIG. 3, regulates the pressure differential in response to input current.

Although the preferred embodiments of this invention have been shown described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A valve assembly comprising a housing having an inlet chamber connected to a fluid motor, and an exhaust chamber connected to exhaust means, control orifice means interposed between said inlet chamber and said fluid motor, first valve means having control means and fluid throttling means operable to throttle fluid flow from said inlet chamber to said exhaust chamber to maintain a constant pressure differential at a preselected constant level across said control means at said first valve means and to maintain a constant pressure differential across said control orifice means, and second valve means having means operable through said fluid throttling means of said first valve means to vary the level of said constant pressure differential across said control orifice means while said pressure differential across said control means of said first valve means remains constant at said constant predetermined level.

2. A valve assembly as set forth in claim 1 wherein said control orifice means has variable area orifice means.

3. A valve assembly as set forth in claim 1 wherein said second valve means has means to vary the level of said constant pressure differential across said control orifice means above the level of said pressure differential across said control means of said first valve means maintained constant at said constant predetermined level.

4. A valve assembly as set forth in claim 1 wherein said second valve means includes constant pressure reducing means, orifice means upstream of said constant pressure reducing means, and flow orifice means down stream of said constant pressure reducing means.

5. A valve assembly as set forth in claim 1 wherein said second valve means includes flow orifice means and pressure responsive flow control means down stream of said flow orifice means.

6. A valve assembly as set forth in claim 1 wherein said second valve means includes fluid throttling means and orifice means down stream of said fluid throttling means communicable with said exhaust means.

7. A valve assembly as set forth in claim 1 wherein said second valve means includes means responsive to an external control signal.

8. A valve assembly as set forth in claim 1 wherein said second valve means has means to vary the level of said constant pressure differential cross said control orifice means below the level of said pressure differential across said control means of said first valve means maintained constant at said constant predetermined level.

9. A valve assembly comprising a housing having an inlet chamber connected to a fluid motor, an exhaust chamber connected to exhaust means, a first control chamber, and a second control chamber, control orifice means interposed between said inlet chamber and said fluid motor, first pressure signal transmitting means operable to transmit a first pressure signal from down stream of said control orifice means to said first control chamber, second signal transmitting means operable to transmit a second pressure signal from upstream of said control orifice means to said second control chamber, fluid throttling means between said inlet chamber and said exhaust chamber operable to throttle fluid flow from said inlet chamber to said exhaust chamber having means responsive to said first and second control pressure signals to maintain a constant pressure differential at a constant predetermined level between said second and said first control chambers and to maintain a constant pressure differential across said control orifice means, and modifying means of said first control pressure signal operable through said fluid throttling means to vary the level of said constant pressure differential controlled across said control orifice means while said pressure differential between said second and said first control chambers remains constant at said constant predetermined level.

10. A valve assembly as set forth in claim 9 wherein said modifying means of said first control pressure signal has means to vary the level of said constant pressure differential across said control orifice means below the level of said pressure differential between said second and said first control chambers maintained constant at said constant predetermined level.

11. A valve assembly as set forth in claim 9 wherein said modifying means of said first control pressure signal includes constant pressure reducing means, orifice means upstream of said constant pressure reducing means, and flow orifice means down stream of said constant pressure reducing means.

12. A valve assembly as set forth in claim 9 wherein said modifying means of said first control pressure signal includes flow orifice means and a pressure responsive flow control means down stream of said flow orifice.

13. A valve assembly as set forth in claim 9 wherein said modifying means of said first control pressure signal includes fluid throttling means and orifice means down stream of said fluid throttling means communicable with said exhaust means.

14. A valve assembly as set forth in claim 9 wherein said modifying means of said control pressure signal has means responsive to an external control signal.

15. A valve assembly comprising a housing having an inlet chamber connected to a fluid motor, an exhaust chamber connected to exhaust means and a control chamber, control orifice means interposed between said inlet chamber and said fluid motor, fluid throttling means between said inlet chamber and said exhaust chamber operable to throttle fluid flow from said inlet chamber to said exhaust chamber to maintain a constant pressure differential at a constant predetermined level between said control chamber and said inlet chamber and to maintain a constant pressure differential across said control orifice means, pressure signal transmitting means operable to transmit a control pressure signal from upstream of said control orifice means to said control chamber, and modifying means of said control pressure signal operable through said fluid throttling means to vary the level of said constant pressure differential controlled across said control orifice means while said pressure differential between said control chamber and said inlet chamber remains constant at said constant predetermined level.

16. A valve assembly as set forth in claim 15 wherein modifying means of said control pressure signal has means to vary the level of said constant pressure differential across said control orifice means above the level of said pressure differential between said control chamber and said inlet chamber maintained constant at said constant predetermined level.

17. A valve assembly as set forth in claim 15 wherein said modifying means of said control pressure signal includes constant pressure reducing means, orifice means upstream of said constant pressure reducing means, and flow orifice means down stream of said constant pressure reducing means.

18. A valve assembly as set forth in claim 15 wherein said modifying means of said control pressure signal includes flow orifice means and a pressure responsive flow control means down stream of said flow orifice means.

19. A valve assembly as set forth in claim 15 wherein said modifying means of said control pressure signal includes fluid throttling means and orifice means down stream of said fluid throttling means communicable with said exhaust means.

20. A valve assembly as set forth in claim 15 wherein said modifying means of said control pressure signal has means responsive to an external control signal.

21. A valve assembly comprising a housing having a fluid inlet chamber, a fluid supply chamber, at least one load chamber, and exhaust means, first valve means for selectively interconnecting said load chamber with said supply chamber and said exhaust means, said first valve means having a variable orifice means between said load chamber and said exhaust means, second valve means having control means and fluid throttling means operable to throttle fluid flow from said load chamber to said exhaust means to maintain a constant pressure differential at a preselected constant level across said control means of said second valve means and to maintain a constant pressure differential across said variable orifice means, and third valve means having means operable through said fluid throttling means of said second valve means to vary the level of said constant pressure differential controlled across said variable orifice means while said pressure differential across said control means of said second valve means remains constant at said constant predetermind level.

22. A valve assembly comprising a housing having a fluid inlet chamber, a fluid supply chamber, at least one load chamber, and exhaust means, first valve means for selectively interconnecting said load chamber with said supply chamber and said exhaust means, variable orifice means between said load chamber and said exhaust means operable by said first valve means, load pressure sensing means selectively communicable with said load chamber by said first valve means, second valve means having means responsive to pressure in said load pressure sensing means and means responsive to pressure in a control chamber, fluid throttling means in said second valve means operable to throttle fluid flow from said load chamber to said exhaust means to maintain a constant pressure differential at a constant preselected level between said load pressure sensing means and said control chamber and to maintain a constant pressure differential across said variable orifice means, pressure signal transmitting means operable to transmit control pressure signal from down stream of said variable orifice means to said control chamber, pressure signal modifying means in said pressure signal transmitting means operable through said fluid throttling means to vary the level of said constant pressure differential controlled across said variable orifice means while said pressure differential between said load pressure sensing means and said control chamber remains constant at said constant predetermined level.

23. A valve assembly as set forth in claim 22 wherein said first valve means has a neutral position in which it blocks said load pressure sensing means, said first valve means when displaced from said neutral position first connecting said load pressure sensing means with said load chamber before connecting said load chamber with said exhaust means.

24. A valve assembly as set forth in claim 22 wherein said modifying means of said control pressure signal has means operable to vary the level of said constant pressure differential controlled across said variable orifice means below the level of said pressure differential between said load pressure sensing means and said control chamber maintained constant at said constant predetermined level.

25. A valve assembly as set forth in claim 22 wherein said modifying means of said control pressure signal includes constant pressure reducing means, orifice means upstream of said constant pressure reducing means and flow orifice means down stream of said constant pressure reducing means.

26. A valve assembly as set forth in claim 25 wherein said orifice means upstream of said constant pressure reducing means has orifice area adjusting means.

27. A valve assembly as set forth in claim 22 wherein said modifying means of said control pressure signal includes flow orifice means and a pressure responsive flow control means down stream of said flow orifice means.

28. A valve assembly as set forth in claim 27 wherein said flow orifice means has variable area orifice means.

29. A valve assembly as set forth in claim 22 wherein said modifying means of said control pressure signal includes fluid throttling means and orifice means down stream of said fluid throttling means communicable with said exhaust means.

30. A valve assembly as set forth in claim 22 wherein said modifying means of said control pressure signal has means responsive to an external control signal.

31. A valve assembly as set forth in claim 30 wherein said means responsive to an external control signal includes mechanical actuating means.

32. A valve assembly as set forth in claim 30 wherein said means responsive to an external control signal includes fluid pressure actuating means.

33. A valve assembly as set forth in claim 30 wherein said means responsive to an external control signal includes electro-hydraulic actuating means.

34. A valve assembly as set forth in claim 30 wherein said means responsive to an external control signal includes electro-mechanical actuating means.

* * * * *